US009051041B2

(12) United States Patent
Litjens et al.

(10) Patent No.: US 9,051,041 B2
(45) Date of Patent: Jun. 9, 2015

(54) MARINE PROPULSION SYSTEMS HAVING EXHAUST GAS RELIEF OUTLET

(75) Inventors: John J. Litjens, St. Cloud, FL (US); Daniel E. Clarkson, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 235 days.

(21) Appl. No.: 13/594,547

(22) Filed: Aug. 24, 2012

(65) Prior Publication Data

US 2014/0057508 A1 Feb. 27, 2014

(51) Int. Cl.
*B63H 21/32* (2006.01)

(52) U.S. Cl.
CPC ..... *B63H 21/32* (2013.01)

(58) Field of Classification Search
CPC ..... B63H 21/32
USPC ..... 440/88–89
See application file for complete search history.

(56) References Cited

U.S. PATENT DOCUMENTS 3,452,704 A * 7/1969 Watkins ..... 440/57
3,548,428 A * 12/1970 Eades ..... 114/346
4,913,079 A * 4/1990 Nishino ..... 114/357
4,997,398 A * 3/1991 Glen ..... 440/88 R
5,041,036 A * 8/1991 Clark et al. ..... 440/89 R
5,129,847 A * 7/1992 Mondek ..... 440/88 R
5,176,551 A * 1/1993 Blanchard et al. ..... 440/88 R
5,409,409 A * 4/1995 Blanchard et al. ..... 440/54
5,505,644 A * 4/1996 Ousley et al. ..... 440/89 R
5,562,511 A * 10/1996 Blanchard et al. ..... 440/49
5,833,502 A * 11/1998 Anderson ..... 440/69
6,663,451 B1 * 12/2003 Walczak ..... 440/89 R
7,021,262 B1 * 4/2006 Belter et al. ..... 123/184.47
7,074,097 B1 * 7/2006 Seymour et al. ..... 440/89 R
8,051,792 B2 * 11/2011 Mochizuki ..... 114/271
8,246,403 B2 * 8/2012 Woods ..... 440/89 F
8,668,537 B2 * 3/2014 Daikoku et al. ..... 440/76
2002/0111088 A1 * 8/2002 Tsubouchi et al. ..... 440/88
2008/0026654 A1 * 1/2008 Konakawa et al. ..... 440/89 J
2012/0325136 A1 * 12/2012 McGill, Jr. ..... 114/56.1
2014/0057508 A1 * 2/2014 Litjens et al. ..... 440/89 J

* cited by examiner

*Primary Examiner* — Lars A Olson
*Assistant Examiner* — Jovon Hayes
(74) *Attorney, Agent, or Firm* — Andrus Intellectual Property Law LLP

(57) ABSTRACT

A marine propulsion system is for propelling a marine vessel in water. The system comprises an outboard motor that is coupled to a marine vessel, and that comprises an exhaust gas relief outlet that is located above the water when the outboard motor is at idle speed. A conduit conveys exhaust gas from the exhaust gas relief outlet to a discharge outlet located on the marine vessel.

8 Claims, 3 Drawing Sheets

MARINE PROPULSION SYSTEMS HAVING EXHAUST GAS RELIEF OUTLET

FIELD

The present disclosure relates to marine propulsion systems and particularly to exhaust systems for marine propulsion systems.

BACKGROUND

U.S. Patent Application Publication No. 2012/0028517 discloses a marine vessel including an outboard motor mounting portion provided at a stern of a hull, an outboard motor locating hole provided rearward of the outboard motor mounting portion and near the outboard motor mounting portion and penetrating vertically through the stern, a platform provided rearward of the outboard motor locating hole, and an outboard motor located in the outboard motor locating hole and mounted to the outboard motor mounting portion. This structure enables an occupant of the marine vessel to freely move in a space around the outboard motor on the platform and use the space.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Through research and experimentation, the present inventors have discovered that marine propulsion systems, such as described in the above referenced patent publication wherein the outboard motor is enclosed, have certain drawbacks. For example, the present inventors have found that exhaust gas emitted by idle relief components on the outboard motors are entrapped in the enclosed space of the outboard motor. This has been found to cause problems such as ingestion of carbon monoxide gas by the outboard motor, negatively affecting combustion performance. Further, carbon monoxide buildup within the enclosure can present dangerous situations for the operators of the vessel. Therefore, through research and experimentation the present inventors arrived at the present inventive concepts for overcoming these problems.

In one example, a marine propulsion system for propelling a marine vessel in water comprises at least one outboard motor coupled to a marine vessel. The outboard motor comprises an exhaust gas relief outlet that is located above the water when the marine vessel is stationary, the outlet relieving exhaust gas, for example when the marine vessel is idling. A conduit conveys exhaust gas from the exhaust gas relief outlet to a discharge outlet located on the marine vessel. The outboard motor also comprises a primary exhaust gas outlet that is located vertically lower than the exhaust gas relief outlet on the outboard motor and that discharges exhaust gas to the water. The noted conduit can be sloped along its length so that water does not stagnate therein.

BRIEF DESCRIPTION OF THE DRAWINGS

Examples marine propulsion devices and exhaust systems for marine propulsion devices are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different methods and systems described herein may be used alone or in combination with other methods and systems. Various equivalents, alternatives, and modifications are possible within the scope of the appended claims.

Figure 1:
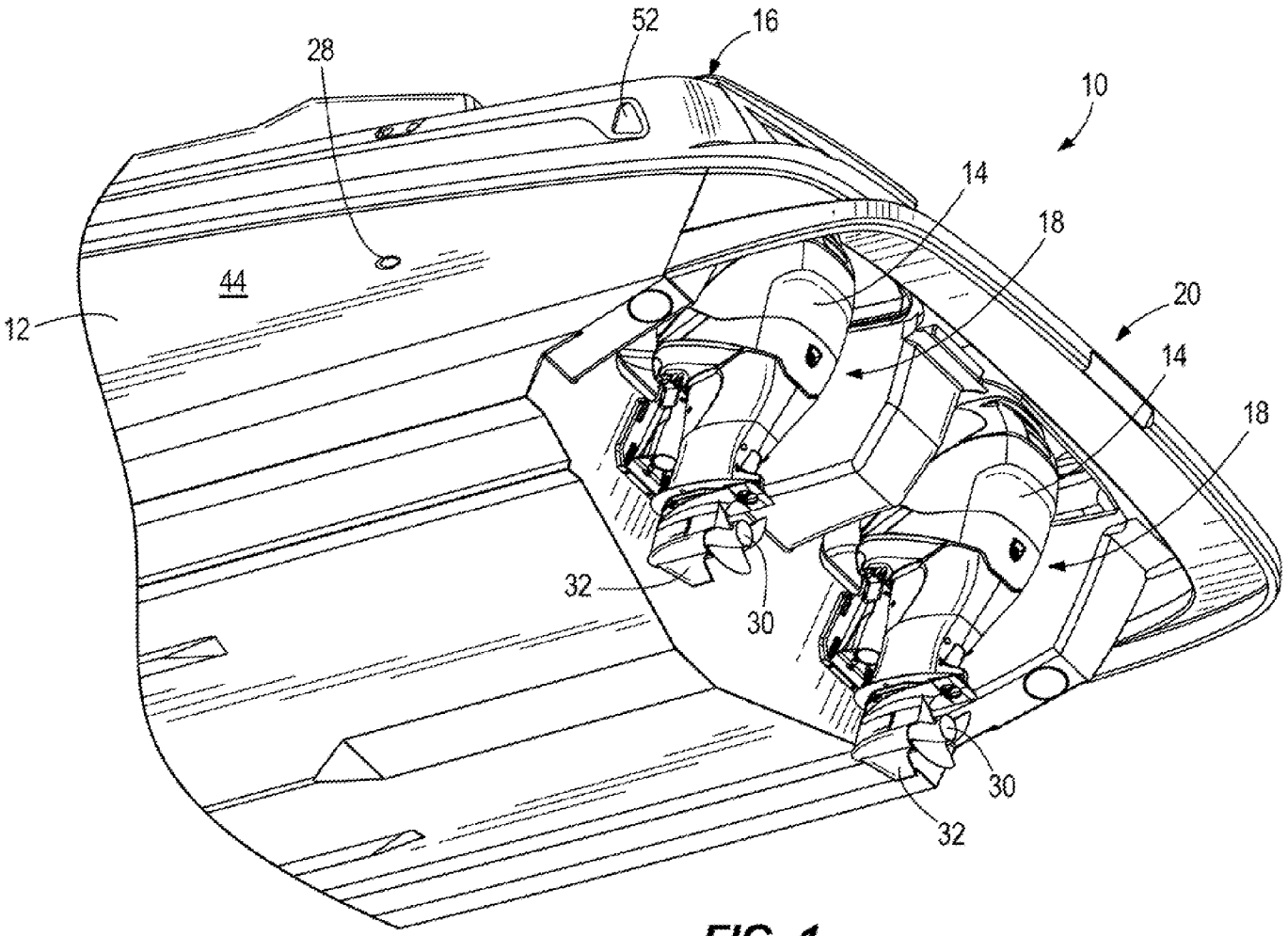
FIG. 1 is a perspective view looking up at the stern of a marine vessel having a pair of outboard motors.
Figure 2:
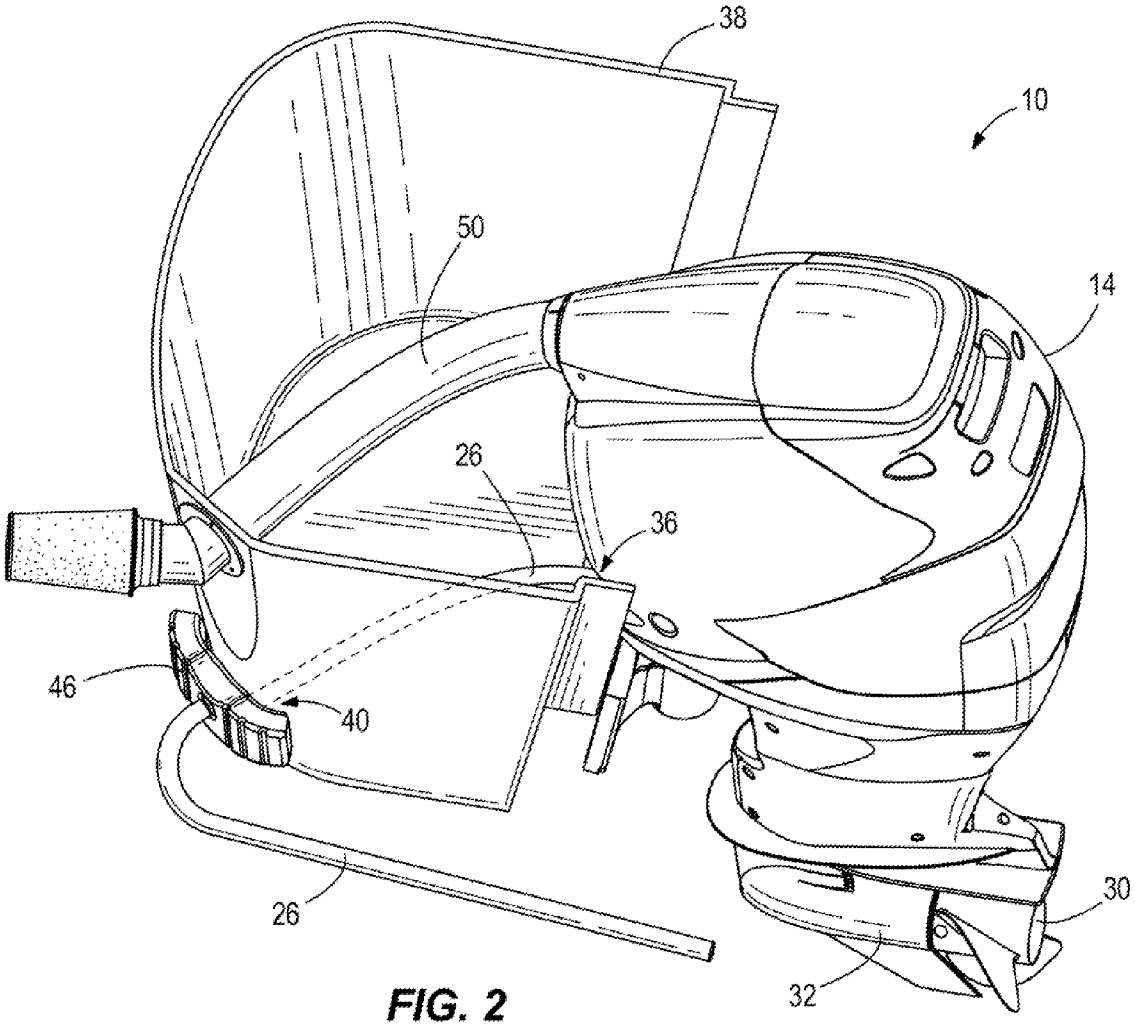
FIG. 2 is a partial top perspective view of one of the outboard motors.
Figure 3:
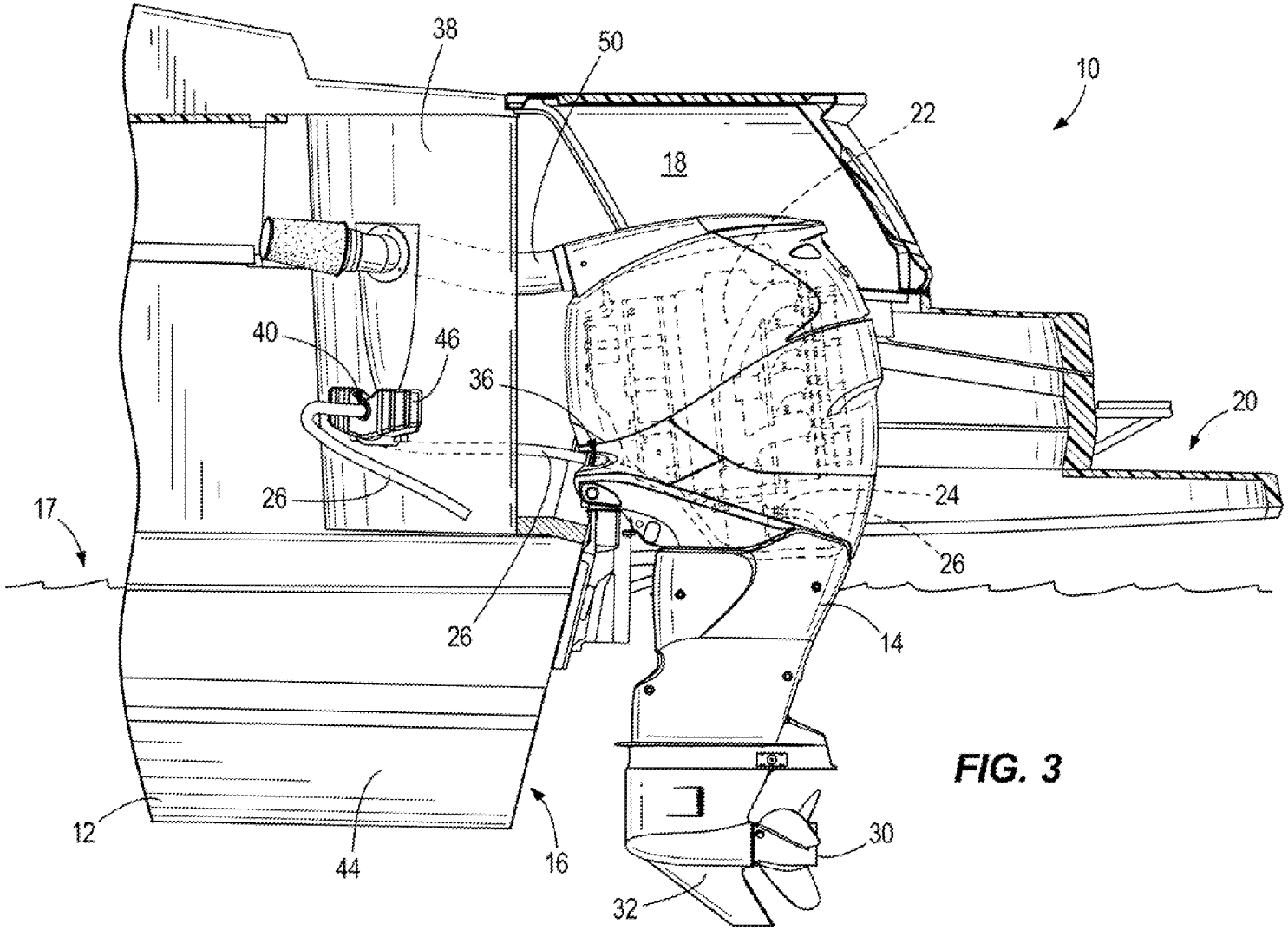
FIG. 3 is a side sectional view of the outboard motor and stern of the marine vessel.

FIGS. 1-3 depict a marine propulsion system 10 for propelling a marine vessel 12 in water. The system 10 includes a pair of outboard motors 14 that are pivotally coupled to the stern 16 of the marine vessel 12, as is conventional. The concepts of the present disclosure are applicable to other types of marine vessels than what is shown in the FIGURES. Also, the number and configuration of the outboard motors 14 can vary from that which is shown. Each outboard motor 14 is enclosed by a portion of the marine vessel 12. In this example, each outboard motor 14 is enclosed in an engine housing 18 that partially or entirely surrounds all sides of the outboard motor 14 that are located above the waterline 17 when the marine vessel 12 is in the water. In this example, as shown in FIG. 3, the engine housing 18 is located at the stern 16 of the marine vessel 12 and provides a swimming platform 20 for a swimmer to move about the stern 16 without interference from the outboard motor 14.

As shown in FIG. 3, each outboard motor 14 has an internal combustion engine 22 that emits exhaust gases in a conventional manner. Each outboard motor 14 has an exhaust gas relief outlet 24 located above the waterline 17 for relieving exhaust gas when, for example, the engine 22 is at idle. The exhaust gas relief outlet 24 can be located on the back of the engine 22, or other locations. As explained further herein below, a flexible conduit 26 conveys exhaust gas from the exhaust gas relief outlet 24 to a discharge outlet 28 located on the marine vessel 12. Each outboard motor 14 also includes a primary exhaust outlet 30 located in the propeller housing 32, which is positioned vertically lower than the exhaust gas relief outlet 24 and which discharges exhaust gas directly to the water. The location of the respective relief outlet 24 and primary exhaust outlet 30 can vary from that which is shown.

As shown in FIGS. 1-3, the conduit 26 includes a flexible hose that extends from the exhaust gas relief outlet 24 through the forward side of the outboard motor 14 (at 36) and then extends through an engine well 38 (at 40) and then to the discharge outlet 28 on the hull 44 of the marine vessel 12. The flexible hose can be connected at locations 24, 28, 36 and 40 by quick-connect fittings or fixed fittings such as a barb with a clamp. In the depicted arrangement, the location 40 at which the conduit 26 extends through the engine well 38 is located vertically higher than the exhaust gas relief outlet 24 and vertically higher than the discharge outlet 28. This positional relationship has been found by the present inventors to provide certain advantages. In addition to exhaust gas, water is often exhausted out of the internal combustion engine 22. Positioning the conduit 26 at elevated location 40 helps prevent water from remaining in the flexible conduit 26 where, for example, the water can freeze in cold environments. Moisture in the conduit 26 can drain either to the discharge outlet 28 or back into the internal combustion engine 22, which is acceptable. Within these concepts, other portions of conduit 26 can be positioned at relative elevations to allow gravity to drain water out of the flexible conduit 26. The location of discharge outlet 28 can vary from that which is shown and can be on either or both of the port or starboard sides of the hull 44. The conduit 26 can be continuously sloped and devoid of low spots along the length of the conduit where water would otherwise stagnate. This avoids the problems discussed above. The flexible nature of the conduit 26 advantageously allows movement of the outboard motor 14 with respect to the engine well 38, for example during tilting, trimming or rotational movement of the outboard motor 14.

A muffler 46 is located on the engine well 38, internally of the hull 42 and is for decreasing idle relief noise. The muffler 46 can instead, optionally be attached to the outboard motor 14.

As shown in FIGS. 1-3, a flexible conduit 50 conveys intake air to the outboard motor 14 from an inlet 52 on the hull 44.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. A marine propulsion system for propelling a marine vessel in water, the system comprising:

an outboard motor coupled to a marine vessel, the outboard motor comprising an exhaust gas relief outlet and a primary exhaust gas outlet that is located lower than the exhaust gas relief outlet on the outboard motor and that discharges exhaust gas to the water; and a conduit that conveys exhaust gas from the exhaust gas relief outlet to a discharge outlet located above the water on the marine vessel when the outboard motor is operated at idle speed so as to discharge exhaust gas to atmosphere when the outboard motor is operated at idle speed;

wherein the conduit is sloped along the entire length so that water does not stagnate therein; and wherein the conduit extends through the marine vessel at a location that is higher than the exhaust gas relief outlet and higher than the discharge outlet.

2. The system according to claim 1, wherein the marine vessel comprises a hull and wherein the discharge outlet is on the hull.

3. The system according to claim 2, wherein the conduit extends through one of a port and starboard side of the hull.

4. The system according to claim 2, comprising a muffler receiving exhaust gas relief from the conduit.

5. The system according to claim 4, wherein the muffler is located on the hull.

6. The system according to claim 1, wherein the outboard motor is at least partially enclosed by a portion of the marine vessel.

7. The system according to claim 6, wherein the portion of the marine vessel is an engine housing that surrounds all sides of the outboard motor that are above the water.

8. The system according to claim 1, wherein the conduit comprises a flexible hose.

* * * * *